US011883735B1

(12) United States Patent
Xeneli

(10) Patent No.: US 11,883,735 B1
(45) Date of Patent: Jan. 30, 2024

(54) SKATEBOARD DEVICE

(71) Applicant: Spartak Xeneli, Tuckahoe, NY (US)

(72) Inventor: Spartak Xeneli, Tuckahoe, NY (US)

( * ) Notice: Subject to any disclaimer, the term of this patent is extended or adjusted under 35 U.S.C. 154(b) by 0 days.

(21) Appl. No.: 17/948,305

(22) Filed: Sep. 20, 2022

(51) Int. Cl.
*A63C 17/12* (2006.01)
*A63C 17/01* (2006.01)
*A63C 17/24* (2006.01)

(52) U.S. Cl.
CPC ..... *A63C 17/016* (2013.01); *A63C 17/013* (2013.01); *A63C 17/24* (2013.01)

(58) Field of Classification Search
CPC ... A63C 17/016; A63C 17/011; A63C 17/013; A63C 17/24
See application file for complete search history.

(56) References Cited

U.S. PATENT DOCUMENTS 4,445,699 A * 5/1984 Darasko ..... B62K 21/005 280/266
9,010,778 B1 * 4/2015 Burns ..... A63C 17/016 280/87.041
2005/0173879 A1 * 8/2005 Park ..... A63C 17/013 280/87.041
2011/0175310 A1 * 7/2011 Lewis ..... A63C 17/016 280/87.042
2012/0091677 A1 * 4/2012 Wu ..... A63C 17/0033 403/26
2015/0238845 A1 * 8/2015 Clayton ..... A63C 17/013 280/87.042
2018/0185740 A1 * 7/2018 De Minicis ..... A63C 17/0086
2019/0160365 A1 * 5/2019 Matsui ..... A63C 17/015
2021/0339115 A1 * 11/2021 Basar ..... A63C 17/012

FOREIGN PATENT DOCUMENTS

JP 4815550 B2 11/2011

* cited by examiner

*Primary Examiner* — Brian L Swenson
(74) *Attorney, Agent, or Firm* — John Rizvi; John Rizvi, P.A—The Patent Professor

(57) ABSTRACT

A skateboard device may include a frame, a set of wheels, and a deck. A user or rider may stand on the deck. The deck may be divided into a front panel and a rear panel, on which the user may rest a front foot and a rear foot, respectively. The rear panel may be fixed relative to the frame. The front panel, in turn, may pivot sideways relative to the frame and, in pivoting sideways, may drive a front wheel fork for rotation in order to steer one or more front wheels of the set of wheels left or right. In some embodiments, the skateboard device may include relatively wide, convex, single front and rear wheels facilitating riding the skateboard device not only on hard, flat surfaces but also on other terrains such as, but not limited to, dirt, gravel, etc.

20 Claims, 9 Drawing Sheets

SKATEBOARD DEVICE

FIELD OF THE INVENTION

The present invention relates generally to skateboard devices, and more particularly, to a skateboard device provided with a standing deck comprising a front panel and a rear panel, wherein the front panel is pivotable sideways to steer the skateboard device and the rear panel is preferably fixed.

BACKGROUND OF THE INVENTION

Skateboards are recreational devices used for transportation, sporting, and other activities. A skateboard typically includes a rigid board, which is attached to a front pair of wheels and a rear pair of wheels. A user may ride the skateboard by standing on the board, and using one foot to push on the ground in order to propel the skateboard forward. When the skateboard is traveling along the ground, the user may stand on the board with both feet until further propelling is needed.

To allow for left and right steering, each pair of wheels is typically attached to the board by a respective steering device, also known as truck. The truck comprises mechanisms configured to steer the wheels left or right depending on the user shifting the board laterally leftward or rightward, respectively, while riding the skateboard. Thus, in order to steer the skateboard, the user must shift their weight sideways on the board. Furthermore, in order to slow down or stop a traveling skateboard, the user must step on the ground with one foot such that friction between the user's foot and the ground decelerates the skateboard.

Normally, skateboarding is practiced on concrete, asphalt, or other hard, typically urban surfaces, due in part to the steering mechanism requiring the board to be significantly pivoted relative to the wheels, which in turn requires the wheels to travel on a hard, flat surface. In addition, the wheels of conventional skateboards must be small, as the turning mechanism requires the wheels to be placed beneath the board.

In practice, having to steer and decelerate a skateboard using one's feet while also maintaining balance on the skateboard is not an easy activity. The risk of falling is significant, as are the consequences of falling on a hard surface. In consequence, skateboarding is mostly practiced by children, teenagers, and young adults.

Accordingly, there is an established need for a solution to at least one of the aforementioned problems. For example, there remains a need for a skateboard device which provides a novel, preferably more stable riding experience.

SUMMARY OF THE INVENTION

The present invention is directed to a skateboard device including a frame, a set of wheels, and a deck configured for the standing thereon of a user or rider. The deck may be divided into a front panel and a rear panel. The rear panel may be fixed relative to the frame. The front panel, in turn, may pivot sideways relative to the frame and, in pivoting sideways, may drive a front wheel fork for rotation in order to steer one or more front wheels of the set of wheels left or right. In some embodiments, the skateboard device may include relatively wide, convex, single front and rear wheels facilitating riding the skateboard device not only on hard, flat surfaces but also on other terrains such as, but not limited to, dirt, gravel, etc.

In a first implementation of the invention, a skateboard device may include a frame and a set of wheels providing rolling mobility to the frame, the set of wheels comprising one or more front wheels and one or more rear wheels. The skateboard device may further include a deck, carried by the frame. The deck may include a front panel and a rear panel configured for the stepping thereon of a front foot and a rear foot of a rider of the skateboard device. The front panel may be pivotable relative to the frame about a first rotation axis. A first pulley may be jointly rotatable with the front panel about the first rotation axis. A second pulley may be jointly rotatable with the one or more front wheels about a second rotation axis. The second rotation axis may have a vertical component such that rotation of the second pulley and one or more front wheels about the second rotation axis turns the one or more front wheels left or right. The skateboard device may further include an elongated member looped around the first and second pulleys. The elongated member may be driven by the first pulley and may drive the second pulley for rotation about the second rotation axis.

In a second aspect, the rear panel may be non-movably secured to the frame.

In another aspect, the frame may include a tubular segment arranged in a front-to-back, longitudinal direction of the skateboard device. The front panel may be pivotably connected to the tubular segment. The first rotation axis may be provided at a central longitudinal axis of the tubular segment.

In another aspect, the front panel and the rear panel may be arranged over the tubular segment.

In another aspect, the rear panel may be non-movably secured to the tubular segment.

In yet another aspect, the front panel and the rear panel may be provided with a respective foot holder configured to extend at least partially over the front foot and the rear foot of the rider when the front foot and rear foot are arranged stepping on the front panel and rear panel, respectively, preventing the front foot and rear foot from moving upward relative to the front panel and rear panel, respectively, when jumping or otherwise riding the skateboard device.

In another aspect, the foot holders of the front panel and rear panel may be aligned along a front-to-back, longitudinal direction of the skateboard device.

In another aspect, the front panel may be provided with a foot stop configured to block a sliding of the front foot from the front panel to the rear panel. Similarly, the rear panel may be provided with a foot stop configured to block a sliding of the rear foot from the rear panel to the front panel.

In another aspect, the foot stops of the front panel and rear panel may be aligned along a front-to-back, longitudinal direction of the skateboard device.

In yet another aspect, the foot holders and foot stops of the front panel and rear panel may be aligned along a front-to-back, longitudinal direction of the skateboard device.

In another aspect, the skateboard device may further include a front wheel fork. The front wheel fork may be pivotably connected to the frame about the second rotation axis. The one or more front wheels may be rotatably attached to the front wheel fork about a front wheel rotation axis. The second pulley may be affixed to the front wheel fork and may be jointly rotatable with the front wheel fork about the second rotation axis.

In another aspect, the skateboard device may further include a support member carried by the frame. The support member may comprise a transverse segment extending along a left-to-right, transverse direction of the skateboard device. The elongated member may extend over the support member and may be re-directed by the transverse segment of the support member such that one side of the elongated member engaged with the first pulley is arranged at an angle with another side of the elongated member arranged engaged with the second pulley.

In another aspect, a front end of the frame may protrude frontward and upward of the deck. The support member may be carried by and extend from the front end of the frame.

In yet another aspect, the support member may include a central segment. The central segment may form a T-shaped arrangement with the transverse segment of the of the support member.

In another aspect, the one or more front wheels may consist of a single front wheel and the one or more rear wheels may consist of a single rear wheel. The single front wheel and single rear wheel may have an outer convex profile.

In another aspect, the skateboard device may further include a braking system. The braking system may include a cable, a user-operable control configured to pull on the cable responsively to user operation of the user-operable control, and a brake member configured to friction against the set of wheels responsively to a pulling by the cable.

In another aspect, the cable may extend arcuately over the deck. The user-operable control may be carried by the cable and arranged at a position operable by a hand of the rider while stepping on the front and rear panel.

In another aspect, the cable may be configured to self-retain its arcuate geometry over the deck.

In yet another aspect, the skateboard device may further include a suspension system. The suspension system may include a compression spring configured to dampen an upward movement of the set of wheels relative to the frame.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a skateboard device comprising a standing deck having a front panel and a rear panel for the resting thereon of a front foot and a rear foot, respectively. The front panel is pivotable sideways, independently of the rear panel and in order to steer the skateboard device, delivering a novel skateboarding experience. In preferred embodiments, the rear panel may be non-movable, providing increased stability to the rider.

Figure 1:
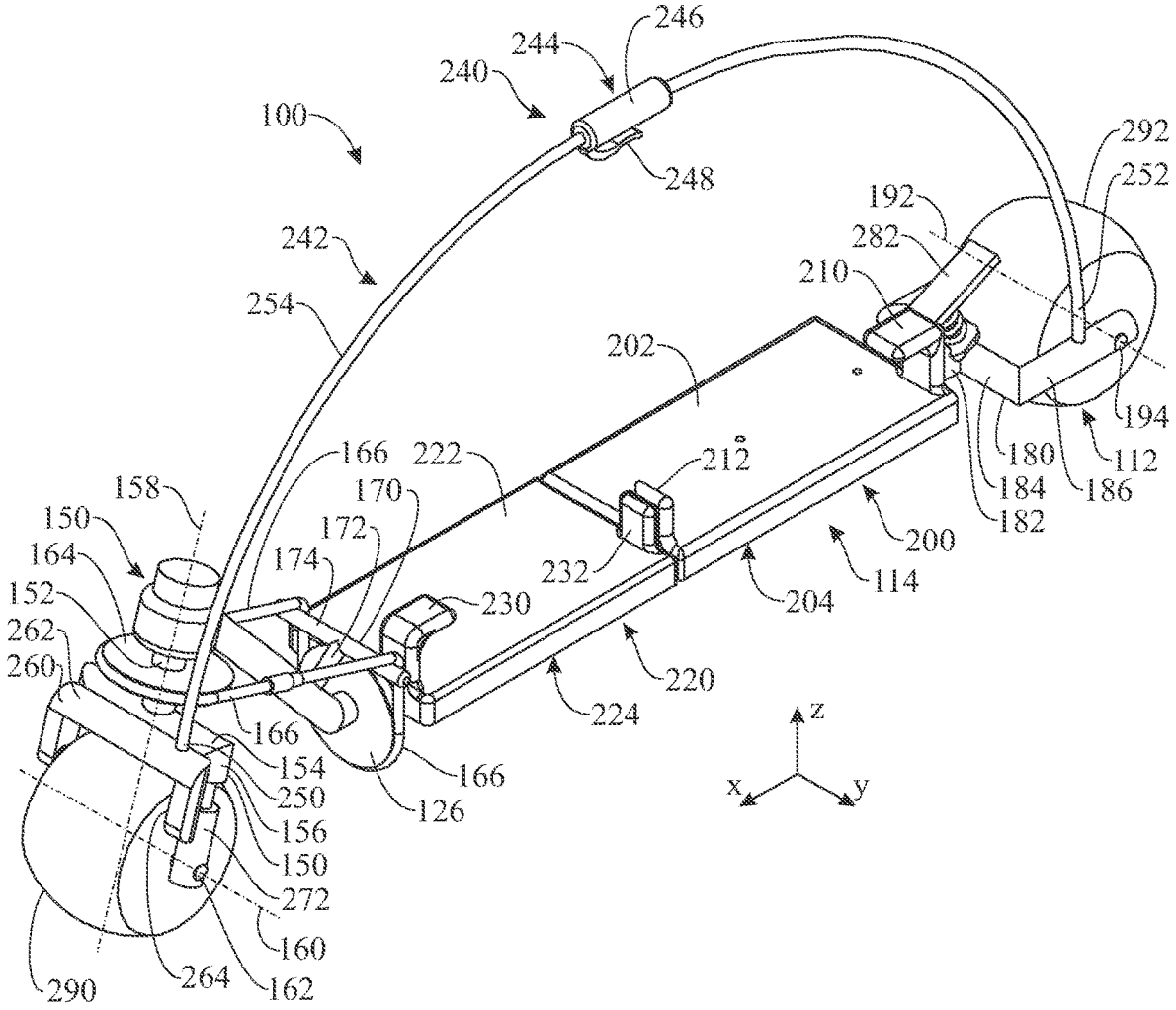
FIG. 1 presents a top, front isometric view of a skateboard device in accordance with an illustrative embodiment of the present invention.
Figure 2:
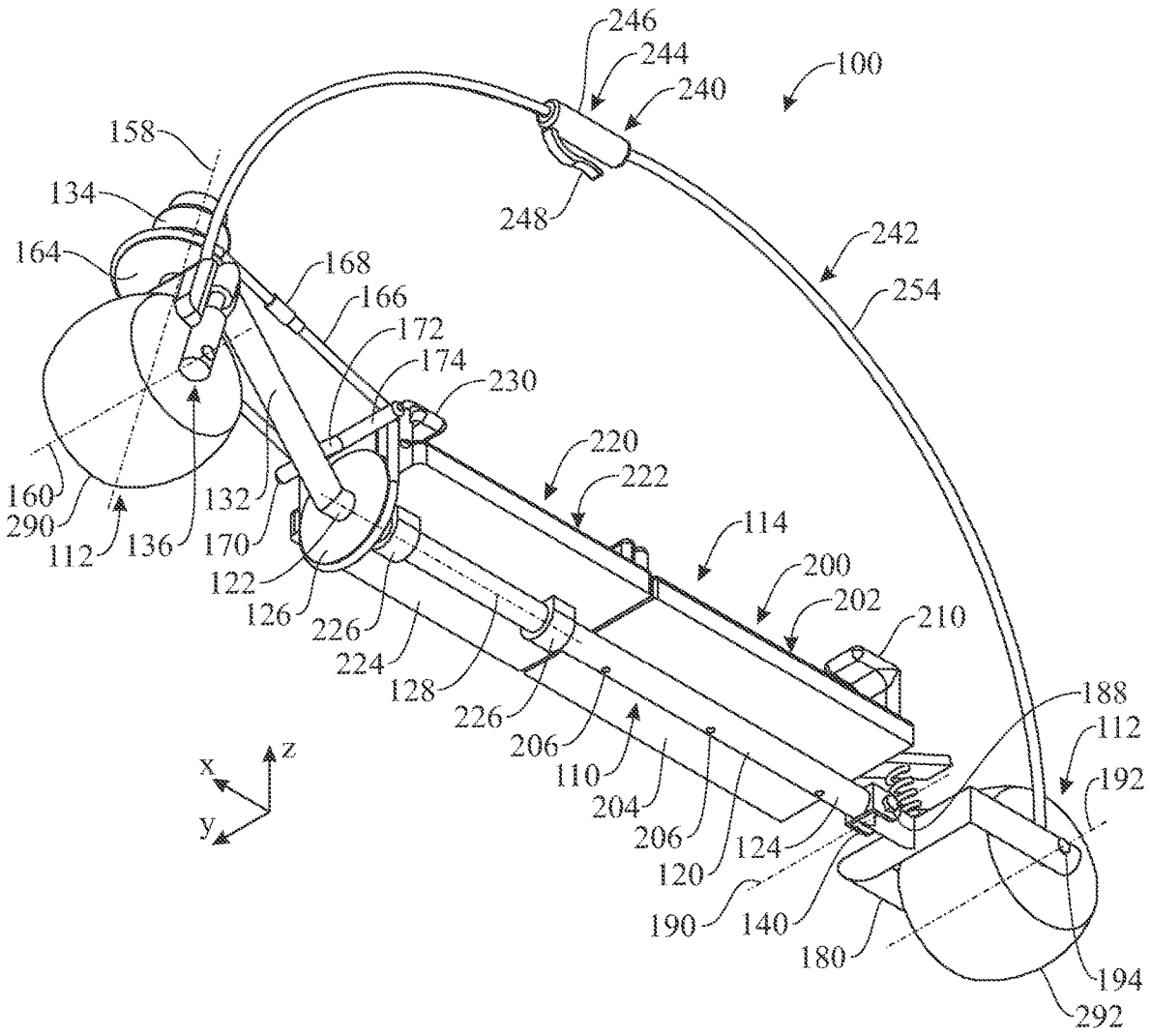
FIG. 2 presents a bottom, front isometric view of the skateboard device of FIG. 1.
Figure 7:
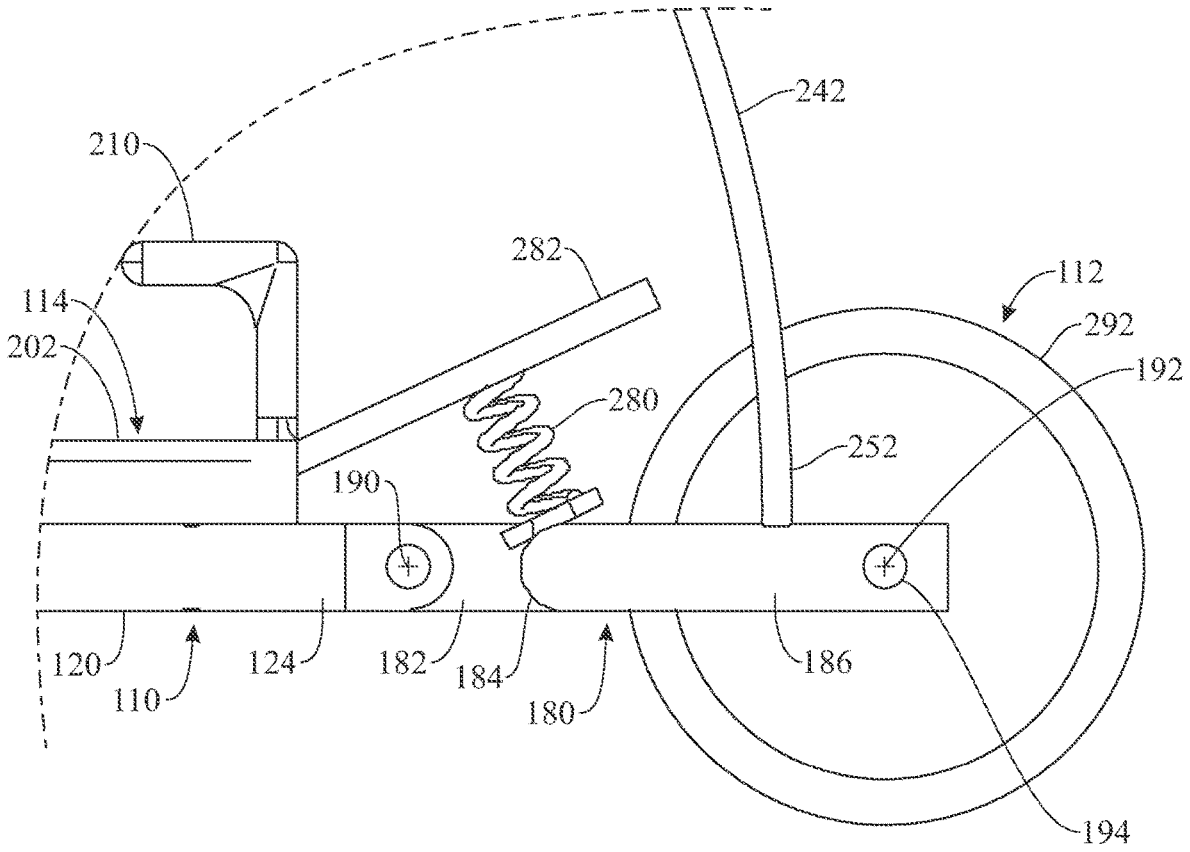
FIG. 7 presents an enlarged, right side elevation view of the area of the rear wheel of the skateboard device of FIG. 1, showing a rear compression spring of a suspension system of the skateboard device.

Referring initially to FIGS. 1 and 2, a skateboard device 100 is shown in accordance with an illustrative embodiment of the present invention. The skateboard device 100 may include a chassis or frame 110, which is best shown in the bottom view of FIG. 2. A set of wheels 112, including one or more front wheels and one or more rear wheels, may be carried by the frame 110 to impart rolling mobility to the skateboard device 100. The skateboard device 100 may further include a deck 114, which may be carried by the frame 110 and configured for the standing thereon of a rider or user 300 (FIG. 7). The user may stand on the deck 114 and propel him or herself forward by pushing on the ground with one foot, or by gravity in the event of skateboarding down a sloped surface.

With reference to FIG. 2, the frame 110 may include a tubular segment 120, which may extend under and along at least a portion of the deck 114 as will be described in greater detail hereinafter. For instance, in the specific embodiment shown in the drawings, the tubular segment 120 extends along the entire length of the deck 114, the length being the dimension of the deck 114 along a front-to-back, longitudinal direction x of the skateboard device 100. The tubular segment 120 may extend generally parallel to a top side of the deck 114 (the top side described hereinafter with reference numerals 202, 222), as shown, or at a slight angle with the top side of the deck 114. The tubular segment 120 may be tubular or partially tubular. In some embodiments, such as the present embodiment, the tubular segment 120 may be generally exposed. Alternatively, the tubular segment 120 may be at least partially covered by a bottom and/or lateral panel or cover to protect the tubular segment 120 during operation of the skateboard device 100, and most particularly, when jumping with the device.

Figure 4:
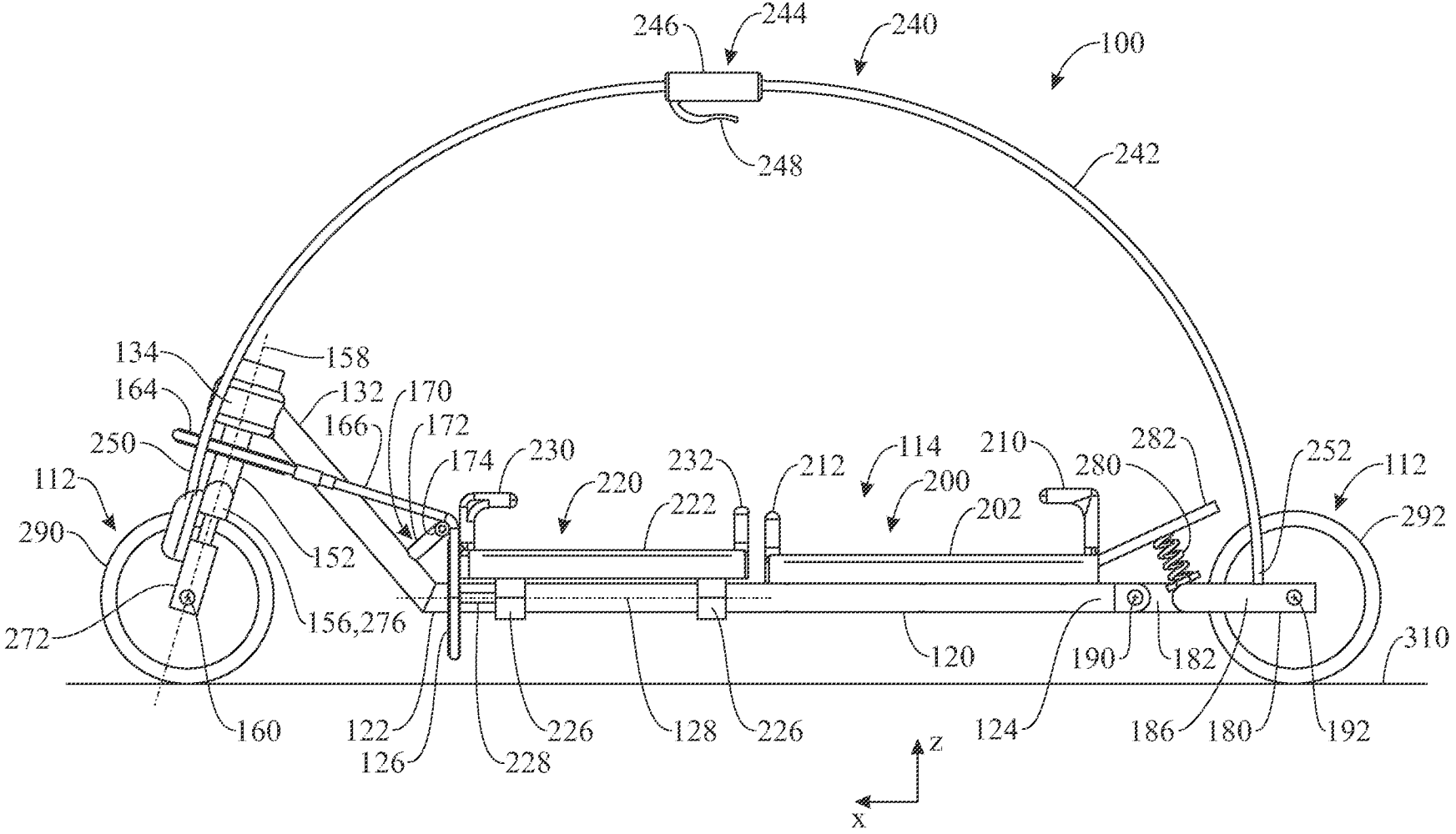
FIG. 4 presents a right side elevation view of the skateboard device of FIG. 1.

In some embodiments, the tubular segment 120 may protrude frontward and/or rearward of the deck 114; for instance, the tubular segment 120 of the present embodiment extends both frontward and rearward from the deck 114. The tubular segment 120 may be arranged relative to the set of wheels 112 such that, when set of wheels 112 rests or rolls on a ground or surface 310 (e.g., a horizontal surface 310 shown in FIG. 4), the tubular segment 120 is arranged generally parallel to the surface 310 (e.g., horizontal as shown in FIG. 4).

With reference to FIG. 2, the tubular segment 120 may have a front end 122 and a rear end 124, which, in some embodiments and as mentioned heretofore, may protrude frontward and rearward from the deck 114, respectively. At the front end 122, a first pulley 126 extends generally perpendicular to and about the tubular segment 120 and is rotatable about a first rotation axis 128 defined by the central longitudinal axis of the tubular segment 120. As will be described in greater detail hereinafter, the first pulley 126 is rotatable by pressing or stepping on the deck 114 with the user's foot 302 (FIG. 7).

Figure 3:
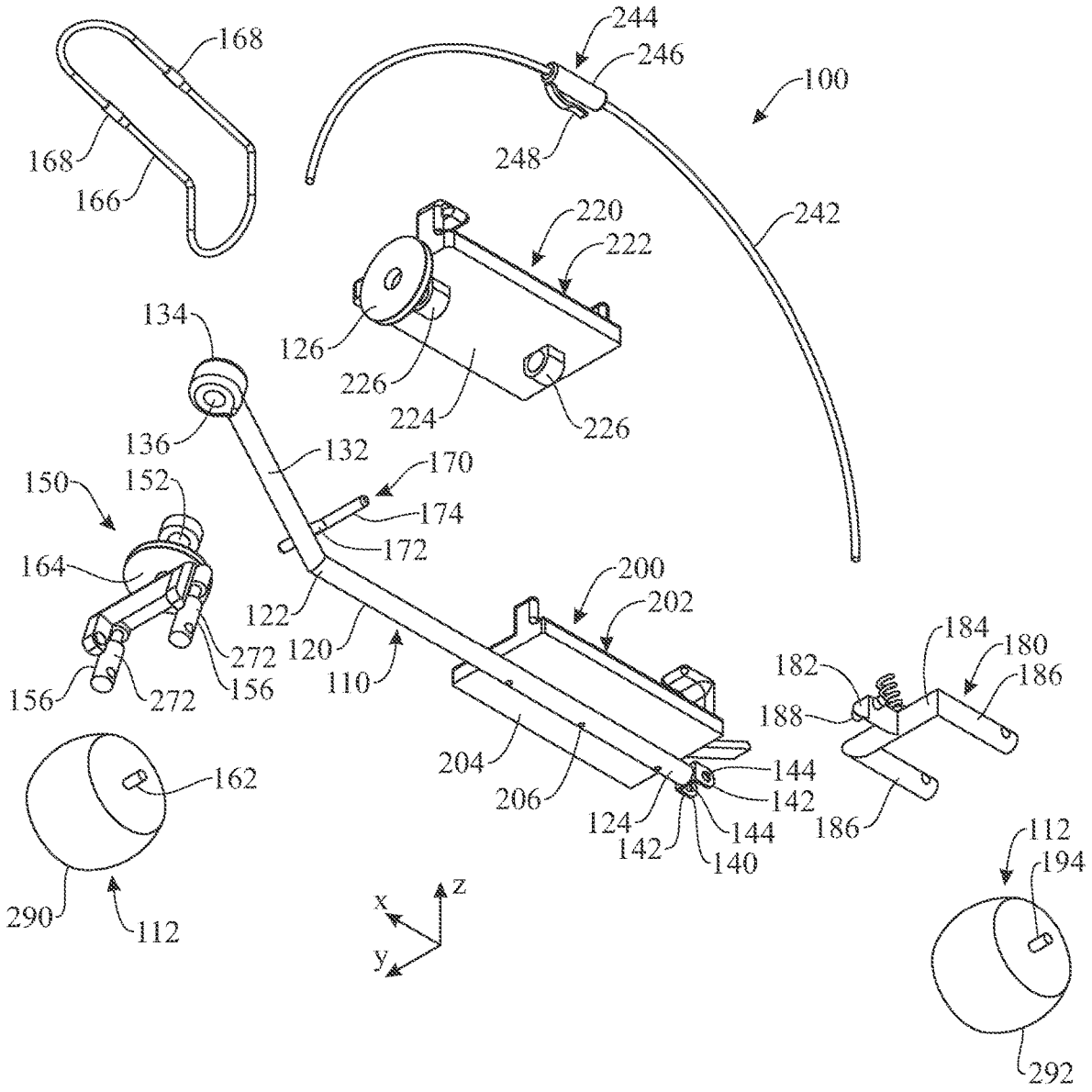
FIG. 3 presents an exploded, bottom front isometric view of the skateboard device of FIG. 1.

Referring to the exploded view of FIG. 3, the frame 110 may further include a connecting portion 132 extending frontward and upward from the front end 122 of the tubular segment 120. The connecting portion 132 may carry a tubular, front connector 134 at a front end thereof, the front connector 134 comprising a through bore 136 which may be generally cylindrical. At the rear end 124, the tubular segment 120 may carry a rear connector 140. The rear connector 140 may be generally C-shaped and include two flanges 142, which may be spaced apart with one another. Each flange 142 may include an opening 144 extending at least partially through the flange 142. The openings 144 of the flanges 142 may be arranged in alignment along a transverse direction y which is perpendicular to the longitudinal and vertical directions x and z, respectively.

A front wheel fork 150 may be rotatably coupled to the front connector 134 of the frame 110 and may rotatably carry the one or more front wheels of the set of wheels 112. As shown in FIGS. 1 and 3, the front wheel fork 150 may have an inverted-Y-shape or other similar fork-type arrangement. For instance, the front week fork 150 depicted herein includes a central post 152, a transverse member 154 extending from a bottom end of the central post 152, and two opposite and spaced-apart side posts 156 extending generally downward from opposite ends of the transverse member 154. The central post 152 is rotatably received within the through bore 136 of the front connector 134 of the frame 110, such that the central post 152, and thus the front wheel fork 150, is rotatable about a second rotation axis 158 defined by the through bore 136 and central post 152.

In turn, the one or more front wheels of the set of wheels 112 may be rotatably carried by the side posts 156 and may rotate about a front wheel rotation axis 160 defined by a wheel axle 162 of the one or more front wheels. The second rotation axis 158 may have a strong vertical component, such that rotation of the front wheel fork 150 about the second rotation axis 158 steers the one or more front wheels left and right. In some embodiments, such as the present embodiment, the second rotation axis 158 may be predominantly vertical and yet slightly sloped rearward to promote stability when steering.

With continued reference to FIGS. 1 and 3, the front wheel fork 150 may carry a second pulley 164. For instance, as shown, the second pulley 164 may be affixed to or integrally formed with the central post 152 of and may extend radially outward from the central post 152. The second pulley 164 may be jointly rotatable with the front wheel fork 150 about the second rotation axis 158. As shown, the second pulley 164 may be perpendicular or substantially perpendicular to the first pulley 126, just as the second rotation axis 158 is perpendicular or substantially perpendicular to the first rotation axis 128. For instance, in the depicted embodiment, the second pulley 164 and second rotation axis 158 are slightly rearward sloped relative to a perfectly perpendicular position relative to the first pulley 126 and first rotation axis 128, respectively. Tin some embodiments, the first and second pulleys 126 and 164 may be sized the same, as shown.

A flexible belt, cable or other elongated member, hereinafter referred to generally as elongated member 166, may be looped and tensioned over the first and second pulleys 126 and 164. The elongated member 166 is configured to convert a rotational movement of the first pulley 126 about the first rotation axis 128 to a rotational movement of the second pulley 164 about the second rotation axis 158. One or more tensioners 168 may be provided on the elongated member 166 for manually adjusting the tension of the elongated member 166.

As further shown in FIGS. 1 and 3, the elongated member 166 may be arranged at an angle allowing to accommodate the generally perpendicular first and second pulleys 126 and 164. For instance and without limitation, the elongated member 166 may slidably fold over a support member 170. The support member 170 may be generally fixed relative to the frame 110; for instance, in some embodiments, such as the present embodiment, the support member 170 may be carried by the connecting portion 132 of the frame 110. In a non-limiting example, as shown, the support member 170 may be formed as a T-shaped body comprising a central segment 172 and a transverse segment 174 extending generally perpendicular to the central segment 172 at an end of the central segment 172 opposite the connecting portion 132. The transverse segment 174 may be arranged coplanar with the first pulley 126 and also coplanar with the second pulley 164, i.e. at an intersection between the respective planes on which the first pulley 126 and the second pulley 164 are respectively formed. For example, the transverse segment 174 of the present embodiment extends in the transverse direction y, directly over and coplanar with the generally vertical first pulley 126 and slightly below and coplanar with the slightly sloped second pulley 164. The elongated member 166 may extend over and partially wrap around the transverse segment 174 enabling a change in direction or orientation of the elongated member 166 as the elongated member 166 advances when driven by the first pulley 126. In some embodiments, the transverse segment 174 may include one or more features configured to promote a low-friction passing thereover of the elongated member 166; examples of such features are one or more bearings, a low-friction outer surface, etc.

Turning to the rear end of the frame 110, a rear wheel fork 180 may be attached to the frame 110, such as to the rear end 124 of the tubular segment 120, and may rotatably carry the one or more rear wheels of the set of wheels 112. The rear wheel fork 180 may have an inverted-Y-shape or other similar fork-type arrangement. For instance, the rear week fork 180 depicted herein includes a central post 182, a transverse member 184 extending from a rear end of the central post 182, and two opposite and spaced-apart side posts 186 extending rearward from opposite ends of the transverse member 184. In some embodiments, the rear wheel fork 180 may be pivotably attached to the frame 110; for instance, in the present embodiment, the central post 182 of the rear wheel fork 180 is rotatably received between the flanges 142 and a transverse axle 188 of the rear wheel fork 180 is rotatably received within the openings 144 defining a third rotation axis 190. The rear wheel fork 180 is rotatable relative to the frame 110 about the third rotation axis 190. In some embodiments, such as the present embodiment, the third rotation axis 190 may be arranged along the transverse direction y and may be generally parallel to the ground or other surface 310 (FIG. 4), such that the rear wheel fork 180 is rotatable upward and downward along a longitudinal and vertical plane or x-z plane. In turn, the one or more rear wheels of the set of wheels 112 may be rotatably carried by the side posts 186 and may rotate about a rear wheel rotation axis 192 defined by a wheel axle 194 of the one or more rear wheels. The rear wheel rotation axis 192 and one or more rear wheels may pivot upward and downward relative to the frame 110 about the third rotation axis 190, carried by the rear wheel fork 180.

Referring to FIGS. 1-3, the deck 114 may include a rear panel 200 and a front panel 220. The rear panel 200 may include a top surface or side 202, configured for the stepping thereon of a user 300 (FIG. 7), and a bottom surface or side 204. In some embodiments, the rear panel 200 may be generally fixed or non-movable relative to the frame 110, which may extend along the bottom side 204 of the rear panel 200. For instance, in the present embodiment, the rear panel 200 is non-movably secured to the frame 110 by bolts 206. The rear panel 200 of the present embodiment is configured to remain fixed relative to the frame 110, and to travel jointly with the frame 110 along the ground or surface 310, during operation of the skateboard device 100.

The front panel 220 may similarly include a top surface or side 222 configured for the stepping thereon by the user 300, and a bottom surface or side 224. However, unlike the rear panel 200, the front panel 220 may be movably secured to the frame 110. More specifically, the front panel 220 may be configured such that movement of the front panel 220 relative to the frame 110 allows to operate the first pulley 126 to steer the one or more front wheels of the set of wheels 112 as described heretofore. For instance, in some embodiments, such as the present embodiment, the first pulley 126 may be fixedly connected to or integrally formed with the front panel 220, and jointly rotatable with the front panel 220 relative to the frame 110 about the first rotation axis 128. A pair of brackets 226 may be fixedly attached to or integrally formed with the front panel 220 and may extend from the bottom side 224 thereof. The tubular segment 120 of the frame 110 may be rotatably received within and extend through the pair of brackets 226, such that the front panel 220, pair of brackets 226, and first pulley 126 are jointly rotatable relative to and about the tubular segment 120 about the first rotation axis 128. In the non-limiting example shown in the drawings, the first pulley 126 is non-rotationally affixed to a front bracket of the pair of brackets 226 by at least one longitudinal bar 228 (FIG. 4), which enables a joint rotation of the first pulley 126 together with the front panel 220 and pair of brackets 226.

With reference to FIGS. 1 and 4, the rear panel 200 may include at least one foot holder 210 configured to extend at least partially over one of the user's feet 302 (FIG. 7), which is stepping on the top side 202 of the rear panel 200. In some embodiments, the foot holder 210 may be shaped as inverted L, as shown. The foot holder(s) 210 may be attached to or integrally formed with the rear panel 200, and may extend upward from the top side 202 of the rear panel 200. Alternatively or additionally, the front panel 220 may include at least one foot holder 230 configured to extend at least partially over the other foot 302 (FIG. 7), which is stepping on the top side 222 of the front panel 220. In some embodiments, the foot holder 230 may be shaped as inverted L, as shown. The foot holder(s) 230 may be attached to or integrally formed with the front panel 220, and may extend upward from the top side 222 of the front panel 220. In some embodiments, the foot holders 210, 230 may be generally rigid or undeformable during use. Alternatively or additionally, the foot holders 210, 230 may be size-adjustable and/or repositionable to conform to different user sizes or preferences.

As further shown in FIGS. 1 and 4, the rear panel 200 may include at least one foot stop 212 configured to block a movement of the user's foot 302 along the top side 202 of the rear panel 200, such as a shifting of the foot 302 towards the front panel 220. The foot stop(s) 212 may be attached to or integrally formed with the rear panel 200, and may extend upward from the top side 202 of the rear panel 200. Alternatively or additionally, the front panel 220 may include at least one foot stop 232 configured to block a movement of the user's foot 302 along the top side 222 of the front panel 220, such as a shifting of the foot 302 towards the rear panel 200. The foot stop(s) 232 may be attached to or integrally formed with the front panel 220, and may extend upward from the top side 222 of the front panel 220.

In the non-limiting example shown in the drawings, the rear panel 200 more specifically includes a single, generally rigid, inverted-L-shaped foot holder 210 integrally formed with the rear panel 200 at a rear end thereof, and a single, generally rigid, vertical foot stop 212 integrally formed with the rear panel 200 at a front end thereof, adjacent to the front panel 220. In turn, the front panel 220 specifically includes a single, generally rigid, inverted-L-shaped foot holder 230 integrally formed with the front panel 220 at a front end thereof, and a single, generally rigid, vertical foot stop 232 integrally formed with the front panel 220 at a rear end thereof, adjacent to the rear panel 200. The inverted L-shaped foot holders 210 and 230 are arranged facing one another and configured to maintain the user's feet 302 (FIG. 7) in a relatively spaced-apart relationship with each other along the deck 114. In turn, the foot stops 212 and 212 are arranged adjacent to each other and configured to stop each foot 302 from slipping from the current, rear or front panel 200, 220 onto the adjacent, rear or front panel 220, 200, respectively.

In some embodiments, as shown, the foot holder 210 and foot stop 212 of the rear panel 200 may be longitudinally aligned, i.e. aligned with one another along the longitudinal direction x. Alternatively or additionally, the foot holder 230 and foot stop 232 of the front panel 220 may be longitudinally aligned. Alternatively or additionally, the foot holders 210 and 230 of the rear and front panels 200 and 220, respectively, may be longitudinally aligned. Alternatively or additionally, the foot stops 212 and 232 of the rear and front panels 200 and 220, respectively may be longitudinally aligned. Such longitudinal alignments may contribute to promote a frontward positioning of one foot 302 versus the other foot 302 on the front and rear panels 220 and 200, respectively. In the non-limiting example shown in the drawings, for instance, all foot holders 210, 230 and foot stops 212, 232 are longitudinally aligned with each other.

Figure 5:
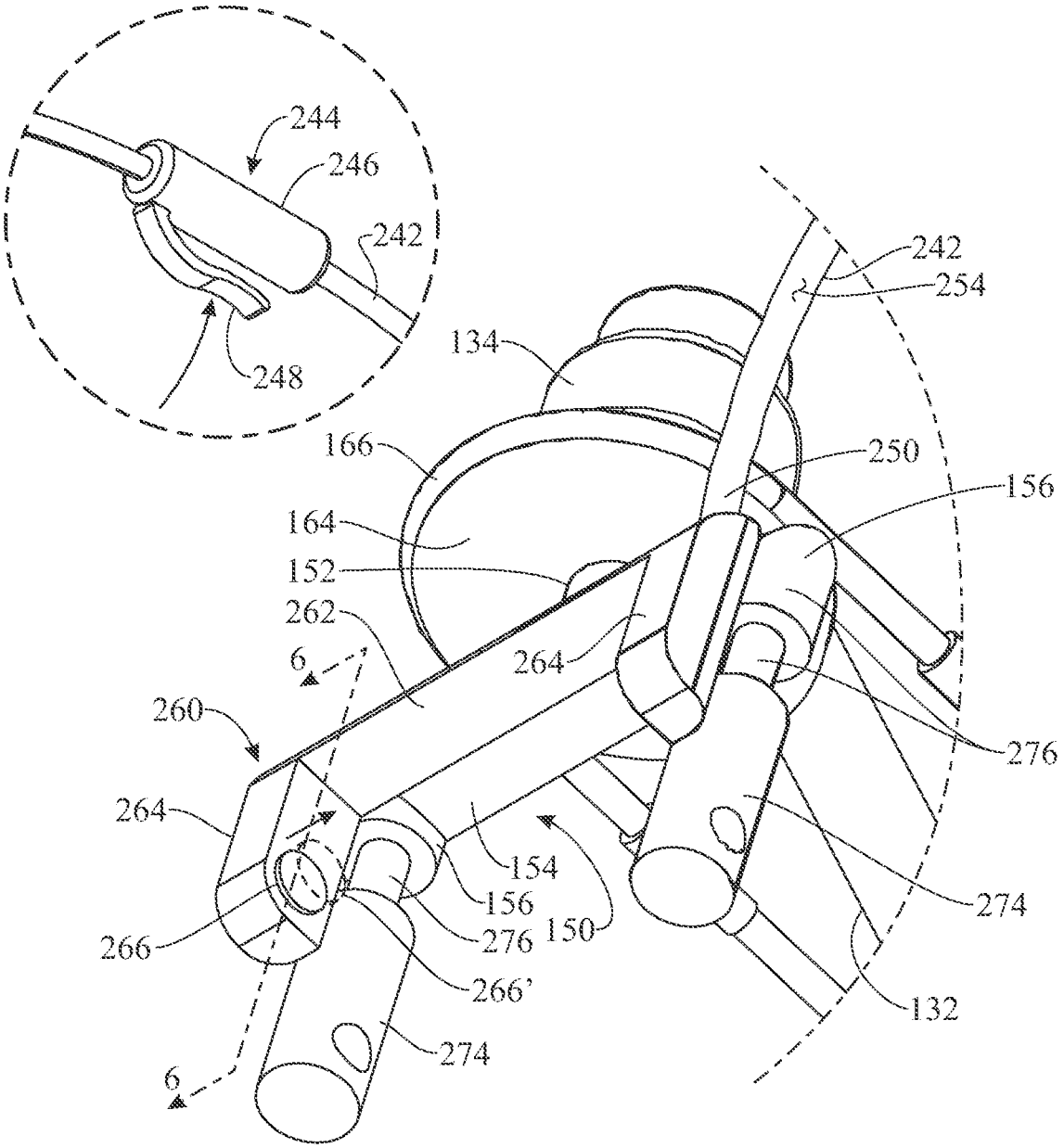
FIG. 5 presents an enlarged, bottom front isometric view of a front wheel fork and a front bracket of a braking system of the skateboard device of FIG. 1, and further illustrates a user-operable control configured to actuate the braking system.
Figure 6:
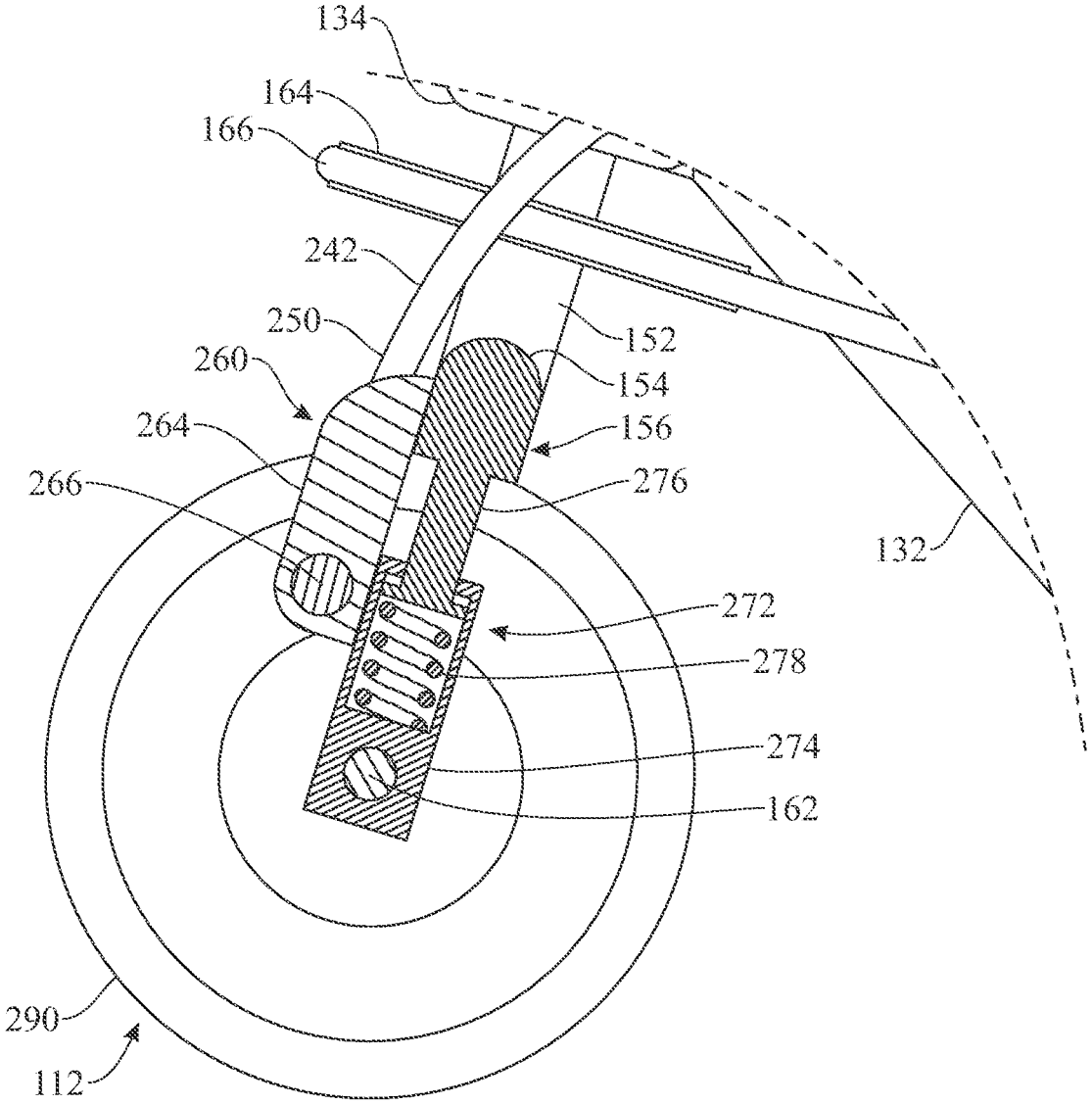
FIG. 6 presents a cross-sectional right side elevation view of the front wheel fork, front bracket, front wheel, and second pulley of the skateboard device of FIG. 1, the cross-section taken along section plane 6-6 indicated in FIG. 5.

With reference to FIGS. 1, 5 and 6, in some embodiments, the skateboard device 100 may include a braking system 240 enabling the user 300 to selectively decelerate the skateboard device 100 without having to step on the ground or surface 310. The braking system 240 may exert frictional forces on the front and/or rear wheels of the set of wheels 112. For example, in the specific embodiment shown in the drawings, the braking system 240 is configured to friction against, and decelerate, the one or more front wheels of the set of wheels 112.

The braking system 240 may include a cable 242 and a user-operable control 244 operatively interfacing with the cable 242 and allowing the user 300 to operate the braking system 240 via the cable 242. In the non-limiting example shown in the drawings, the user-operable control 244 includes a handle 246 and a lever 248 pivotably carried by the handle 246. The lever 248 may be connected to the cable 242 such that compressing the lever 248 exerts a pulling force on a front end 250 of the cable 242, releasing the lever 248 relaxes or ceases said pulling force on the front end 250 of the cable 242, for instance and without limitation. In some embodiments, the skateboard device may include one or more batteries and one or more electric motors configured to electrically operate the skateboard device; the motor(s) may be operable via the user-operable control 244, for instance and without limitation.

In some embodiments, the user-operable control 244 may be located at an easy reach by one or both hands of the user 300 who is standing on the deck 114. In preferred embodiments, such as the present embodiment, the user-operable control 244 may be generally centrally located along the deck 114 along the longitudinal direction x, facilitating operating the user-operable control 244 with either hand when the user 300 is standing with each foot 302 on a respective panel of the rear and front panels 200, 220.

For example, a rear end 252 the cable 242, opposite to the front end 250, may extend from the rear wheel fork 180, as shown, or from another portion of the skateboard device 100 arranged rearward of the deck 114, minimizing or preventing the cable 242 from interfering with the user's rear foot 302. In turn, the front end 250 of the cable 242 may be located near the one or more front wheels, as will be described in greater detail hereinafter. In some embodiments, such as the present embodiment, the cable 242 may arcuately extend over the deck 114. The user-operable control 244 may be arranged at or near a top of the arcuate cable 242, readily available for the user 300 to manually operate the lever 248. The user-operable control 244 may also be grasped by the user while jumping with the skateboard device 100, for increased user stability and to achieve a greater engagement between the user and the skateboard device 100. In some embodiments, the handle 246 may have an ergonomic, non-slip, and/or other shape or texture to promote stable gripping of the handle 246 by the user's hand.

Preferably, the cable 242 is generally rigid and maintains the arcuate shape and position during operation of the skateboard device 100. In some embodiments, the cable 242 may be provided with an outer cover 254 imparting rigidity to the cable 242, to facilitate the cable 242 maintaining its arcuate shape. The outer cover 254 may extend along at least part of the length of the cable 242, and preferably along generally the entirety of the arcuate cable 242.

With continued reference to FIGS. 1, 5 and 6, the braking system 240 may include a front bracket 260, which may be adjacent to the one or more front wheels of the set of wheels 112. The front bracket 260 may be secured to the front wheel fork 150. The front bracket 260 may have an inverted U-shape defined by a transverse member 262 and two spaced-apart, side posts 264 extending from opposite ends of the transverse member 262. The side posts 264 may be located at opposite sides of the one or more front wheels of the set of wheels 112. A brake member 266, such as, but not limited to, a brake piston or pad, may be provided at one or both side posts 264. The brake member 266 may operatively interface with the cable 242 such that pulling on the cable 242 causes the brake member 266 to move from a retracted or non-operated position, shown in solid lines in FIG. 5, to an extended or operated position, shown in phantom lines and indicated with reference numeral 266' in FIG. 5. In the retracted position, the brake member 266 may have minimal or no contact with the one or more front wheels. In the extended position, instead, the brake member 266 may significantly contact and friction against the one or more front wheels, relative to the retracted position, such that the friction force may decelerate the rotating wheel(s).

In some embodiments, the skateboard device 100 may include a suspension system 270 at the front and/or rear wheels of the set of wheels 112. For example, in the specific embodiment shown in the drawings, the suspension system 270 provides a suspension or dampening effect at both the front and the rear wheels of the set of wheels 112.

With reference to FIGS. 5 and 6, in order to dampen a vertical displacement of the one or more front wheels of the set of wheels 112, the suspension system 270 may include a pair of dampers 272 at the front wheel fork 150. For example, as shown, each damper 272 may be comprised in or provide a respective one of the side posts 156 of the front wheel fork 150. In some embodiments, such as the present embodiment, the dampers 272 may be coil spring dampers. Each damper 272 may include an outer casing 274 and a piston 276 arranged partially within and slidably movable along the casing 274. A compression spring 278 may be arranged within the casing 274 and configured to exert an outward pushing force on the piston 276 to shift the piston 276 out of the casing 274. The bottom ends of the casings 274, opposite the pistons 276, may be attached to the wheel axle 162 of the one or more front wheels of the set of wheels 112 such that there is no relative vertical movement between said bottom ends and the wheel axle 162. In turn, the outermost or top end of each piston 276, opposite the bottom end of the corresponding casing 274, may be affixed to or otherwise integrally formed with a top area of the respective side post 156 or with the transverse member 154 of the front wheel fork 150, such that the pistons 276 and the transverse member 154 and central post 152 of the front wheel fork 150 are jointly displaceable along the axial direction of the central post 152 (second rotation axis 158). By interfacing between the wheel axle 162 and the central post 152 , the compression springs 278 may dampen a movement of the wheel axle 162 towards the central post 152, and thereby dampen a movement of the one or more front wheels towards the frame 110.

With reference to FIGS. 1, 4 and 7, in order to dampen a vertical movement of the one or more rear wheels of the set of wheels 112, the suspension system 270 may include a compression spring 280 operating between the frame 110 and the rear wheel fork 180. A first end of the compression spring 280 may engage with and extend from a seat 282. The seat 282 may be integrally formed with or non-movably attached to the deck 114 and/or the frame 110. For instance, in the present embodiment, the seat 282 is integrally formed with the rear panel 200 of the deck 114 and protrudes rearward of the foot holder 210 of the rear panel 200. An opposite, second end of the compression spring 280 may in turn engage with the rear wheel fork 180, such as with the transverse member 184 of the rear wheel fork 180, as shown. The compression spring 280 may dampen an upward movement of the one or more rear wheels of the set of wheels 112 by dampening an upward pivoting of the rear wheel fork 180 relative to the deck 114 and frame 110 about the third rotation axis 190.

In some embodiments, such as the present embodiment, the one or more front wheels may consist of a single, relatively wide front wheel 290. Alternatively or additionally, and preferably additionally, the one or more front wheels may consist of a single, relatively wide rear wheel 292. The single, front and rear wheels 290 and 292 may have a convex outer surface or profile, as shown. The relatively wide front and rear wheels 290, 292 may allow the skateboard device 100 to be operated not only on concrete or asphalt but also on dirt, gravel or other rough terrain. Furthermore, the convex outer shape of the front and rear wheels 290 and 292 allow the relatively wide wheels to provide a relatively narrow point of contact (at the center or most protruding edge of the wheels) with the ground or surface 310, thereby giving the user 300 a bicycle-like feeling of balance when riding the skateboard device 100.

Figure 8:
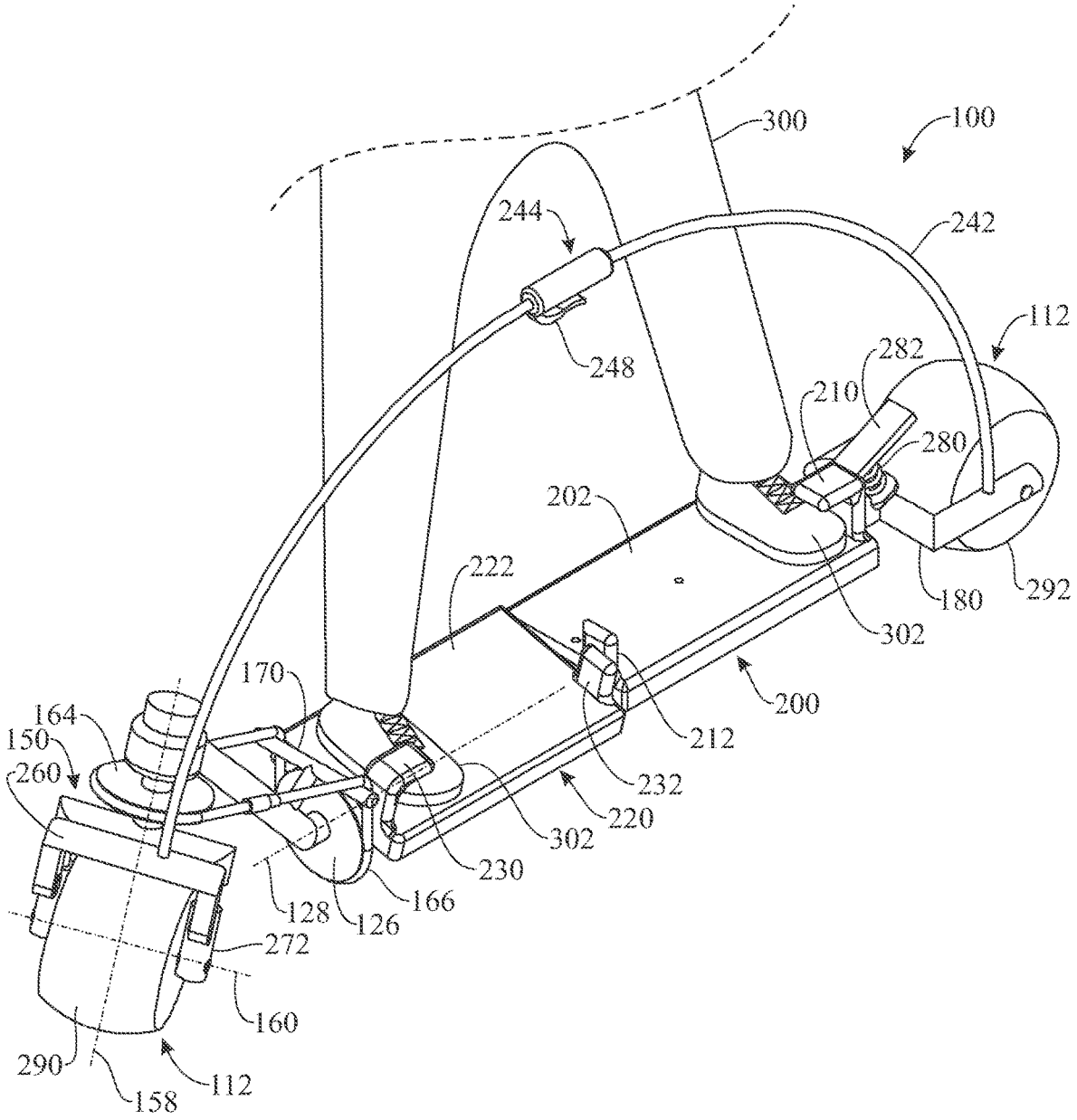
FIG. 8 presents a top, front isometric view of a user riding the skateboard device of FIG. 1 and shifting the front panel leftward to steer the front wheel towards the left.

In an illustrative method of operation of the skateboard device 100, and with reference initially to FIG. 8, a rider or user 300 may stand on the skateboard device 100 typically by resting each foot 302 on the corresponding top side 222, 202 of a respective one of the front and rear panels 220 and 200 of the deck 114. The user 300 may optionally place one or both feet 302 below the corresponding foot holder 230, 210, in which case the foot holder 230, 210 may contribute to retain the corresponding foot 302 in place relative to the panel 220, 200, at least partially. This engagement with the foot holders 230, 210 may prevent an upward and/or transverse movement of the foot 302 relative to the panel 220, 200, thereby facilitating riding the skateboard device 100, including jumping with the skateboard device 100. In embodiments in which the foot holders 230, 210 are longitudinally aligned, the foot holders 230, 210 may promote the user 300 riding the skateboard device 100 with his/her feet 302 in longitudinal alignment as shown in FIG. 8.

While standing on the deck 114, the user 300 may load most of his/her weight on the fixed, rear panel 200 via the rear foot 302. To propel the skateboard device 100 forward in the event of riding on a horizontal or upward-sloped surface 310, the user 300 may push on the surface with the front foot 302. Once the skateboard device 100 is rolling on the surface 310, the front foot 302 may be placed on the front panel 220, such as engaged with the foot holder 230. As the user 300 rides the skateboard device 100, the user may wish to grasp the cable 242 or, more preferably, the handle 246 (if any) for increased stability; alternatively, the user 300 may select not to grasp the cable 242 or handle 246 and instead ride hands-free, which may be more challenging.

Figure 9:
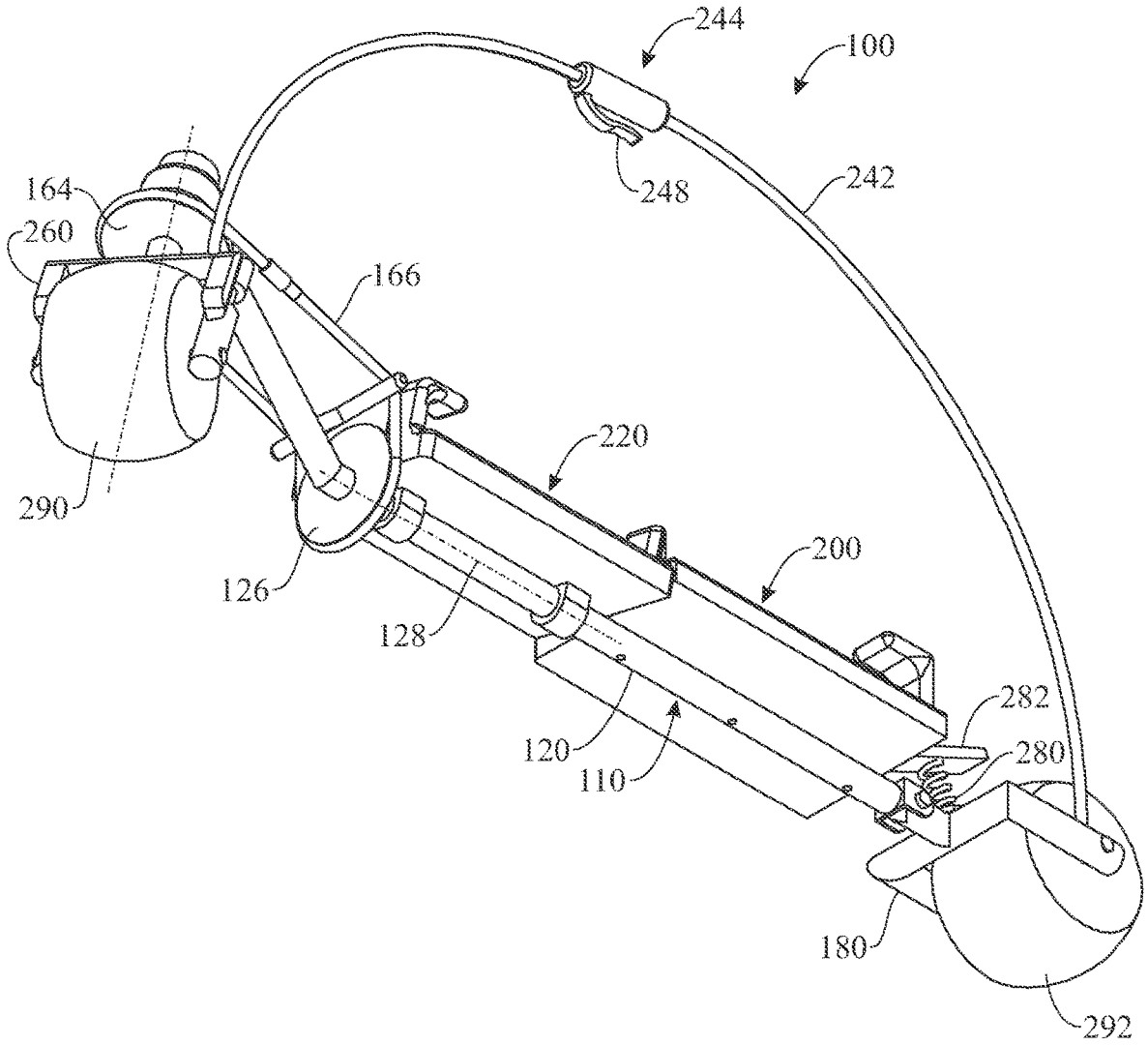
FIG. 9 presents a bottom, rear isometric view of the skateboard device in the leftward-steered position of FIG. 8.

As the skateboard device 100 travels on the ground or surface 310, the user may wish to steer the device towards the right or left, and for this purpose may step on the front panel 220 to pivot the front panel 220 towards the right or left, respectively. The illustrations of FIGS. 8 and 9 show a specific example of operation in which the user 300 is maneuvering the skateboard device 100 to turn left. It should be noted that a rightward turn would be carried out generally symmetrically to the operation shown in FIGS. 8 and 9.

With continued reference to FIGS. 8 and 9, in order to turn left, the user 300 shifts his or her weight on the front foot 302 offset of the first rotation axis 128 of the front panel 220, thereby exerting a torque on the front panel 220 relative to the frame 110 and first rotation axis 128. In consequence, the front panel 220 rotates leftward, as shown, relative to the frame 110 and about the tubular segment 120 of the frame 110 and the first rotation axis 128. As the front panel 220 rotates, the first pulley 126 rotates jointly with the front panel 220, thereby driving the elongated member 166. The elongated member 166, which is supported and re-directed by the support member 170 from a generally vertical position about the first pulley 126 to a substantially horizontal position about the second pulley 164, drives the second pulley 164 for rotation about the second rotation axis 158. The jointly rotatable second pulley 164 and front wheel fork 150 are thus rotated leftward by the elongated member 166 about the second rotation axis 158, causing the one or more front wheels (e.g., the single front wheel 290) to turn left, as shown. As the one or more front wheels rotate leftward, they may continue to rotate about the front wheel rotation axis 160 and on the ground or surface 310.

Should the user wish to stop turning and instead travel forward, the user 300 may shift their weight such that the weight is directed vertically downward and in vertical alignment (over) the first rotation axis 128. Should the user wish to turn right, he or she may instead shift their weight offset the first rotation axis 128 on the right-hand side of the first rotation axis 128. Thus, the user 300 may steer the skateboard device 100 by simply shifting his or her weight relative to the front panel 220 via their front foot 302. As the front panel 220 is operated, the rear foot 302 may remain standing on a fixed or non-turning structure (the rear panel 200), promoting stability. The rear foot 302 optionally engaging with a foot holder (foot holder 210) may further contribute to such stability. Furthermore, the feet 302 being blocked from slipping from their respective current panel 220, 200 to the other panel 200, 220 by the corresponding foot stops 232, 212 may help operate the skateboard device 100 as described, with one foot 302 on each panel 220, 200.

In some embodiments, the user 300 may further operate the braking system 240 as heretofore describe, to decelerate the rotating front wheel or wheels and thereby slow down or stop the skateboard device 100. Alternatively, or in embodiments lacking a braking system, the user 300 may step on the ground or surface 310 with one foot 302 to slow down or stop the device.

In embodiments in which the skateboard device 100 includes relatively wide and convex, single front and rear wheels 290 and 292, respectively, the front and rear wheels 290 and 292 may not only travel on smoother surfaces such as concrete or asphalt, but also on rougher terrain. In some embodiments, suspension system 270 may at least partially insulate the user 300 from terrain irregularities, particularly when riding on rougher terrain.

Alternative embodiments are contemplated without departing from the scope of the present disclosure. For instance, embodiments are contemplated in which the braking system is configured to decelerate the one or more rear wheels of the set of wheels, alternatively or additionally to decelerating the one or more front wheels. In another non-limiting example, the front and rear wheels dampening mechanisms may be interchanged, with one or more coil spring dampers provided at the rear wheel(s) and one or more compression springs provided at the front wheel(s).

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A skateboard device, comprising:

a frame;

a set of wheels providing rolling mobility to the frame, the set of wheels comprising one or more front wheels and one or more rear wheels;

a deck, carried by the frame, the deck comprising a front panel and a rear panel configured for the stepping thereon of a front foot and a rear foot of a rider of the skateboard device, wherein the front panel is pivotable relative to the frame about a first rotation axis;

a first pulley, jointly rotatable with the front panel about the first rotation axis;

a second pulley, jointly rotatable with the one or more front wheels about a second rotation axis, the second rotation axis having a vertical component such that rotation of the second pulley and one or more front wheels about the second rotation axis turns the one or more front wheels left or right; and an elongated member looped around the first and second pulleys, the elongated member driven by the first pulley and configured to drive the second pulley for rotation about the second rotation axis.

2. The skateboard device of claim 1, wherein the rear panel is non-movably secured to the frame.

3. The skateboard device of claim 1, wherein the frame comprises a tubular segment arranged in a front-to-back, longitudinal direction of the skateboard device, wherein the front panel is pivotably connected to the tubular segment, and further wherein the first rotation axis is provided at a central longitudinal axis of the tubular segment.

4. The skateboard device of claim 3, wherein the front panel and the rear panel are arranged over the tubular segment.

5. The skateboard device of claim 3, wherein the rear panel is non-movably secured to the tubular segment.

6. The skateboard device of claim 1, wherein the front panel and the rear panel are provided with a respective foot holder configured to extend at least partially over the front foot and the rear foot of the rider when the front foot and rear foot are arranged stepping on the front panel and rear panel, respectively, preventing the front foot and rear foot from moving upward relative to the front panel and rear panel, respectively.

7. The skateboard device of claim 6, wherein the foot holders of the front panel and rear panel are aligned along a front-to-back, longitudinal direction of the skateboard device.

8. The skateboard device of claim 1, wherein the front panel is provided with a foot stop configured to block a sliding of the front foot from the front panel to the rear panel, and the rear panel is provided with a foot stop configured to block a sliding of the rear foot from the rear panel to the front panel.

9. The skateboard device of claim 8, wherein the foot stops of the front panel and rear panel are aligned along a front-to-back, longitudinal direction of the skateboard device.

10. The skateboard device of claim 1, wherein the front panel and rear panel are provided with a respective foot holder configured to extend at least partially over the front foot and the rear foot of the rider when the front foot and rear foot are arranged stepping on the front panel and rear panel, respectively, preventing the front foot and rear foot from moving upward relative to the front panel and rear panel, respectively, and further wherein the front panel is provided with a foot stop configured to block a sliding of the front foot from the front panel to the rear panel, and the rear panel is provided with a foot stop configured to block a sliding of the rear foot from the rear panel to the front panel, wherein the foot holders and foot stops of the front panel and rear panel are aligned along a front-to-back, longitudinal direction of the skateboard device.

11. The skateboard device of claim 1, further comprising a front wheel fork, pivotably connected to the frame about the second rotation axis, the one or more front wheels rotatably attached to the front wheel fork about a front wheel rotation axis, and further wherein the second pulley is affixed to the front wheel fork and jointly rotatable with the front wheel fork about the second rotation axis.

12. The skateboard device of claim 1, further comprising a support member carried by the frame, the support member comprising a transverse segment extending along a left-to-right, transverse direction of the skateboard device, wherein the elongated member extends over the support member and is re-directed by the transverse segment of the support member such that one side of the elongated member engaged with the first pulley is arranged at an angle with another side of the elongated member arranged engaged with the second pulley.

13. The skateboard device of claim 12, wherein a front end of the frame protrudes frontward and upward of the deck, and further wherein the support member is carried by and extends from the front end of the frame.

14. The skateboard device of claim 13, wherein the support member comprises a central segment, the central segment forming a T-shaped arrangement with the transverse segment of the of the support member.

15. The skateboard device of claim 1, wherein the one or more front wheels consist of a single front wheel and the one or more rear wheels consist of a single rear wheel, the single front wheel and single rear wheel comprising an outer convex profile.

16. The skateboard device of claim 1, further comprising a braking system, the braking system comprising a cable, a user-operable control configured to pull on the cable responsively to user operation of the user-operable control, and a brake member configured to friction against the set of wheels responsively to a pulling by the cable.

17. The skateboard device of claim 16, wherein the cable extends arcuately over the deck, and the user-operable control is carried by the cable and arranged at a position operable by a hand of the rider while stepping on the front and rear panel.

18. The skateboard device of claim 1, further comprising a suspension system, the suspension system comprising a compression spring configured to dampen an upward movement of the set of wheels relative to the frame.

19. A skateboard device, comprising:

a frame, comprising a tubular segment arranged in a front-to-back, longitudinal direction of the skateboard device;

a set of wheels providing rolling mobility to the frame, the set of wheels comprising one or more front wheels and one or more rear wheels;

a deck, carried by the frame, the deck comprising a front panel and a rear panel configured for the stepping thereon of a front foot and a rear foot of a rider of the skateboard device, wherein the front panel is pivotably connected to the tubular segment and pivotable relative to the frame about a first rotation axis defined by a central longitudinal axis of the tubular segment, and the rear panel is non-movably secured to the frame;

a first pulley, jointly rotatable with the front panel about the first rotation axis;

a second pulley, jointly rotatable with the one or more front wheels about a second rotation axis, the second rotation axis having a vertical component such that rotation of the second pulley and one or more front wheels about the second rotation axis turns the one or more front wheels left or right; and an elongated member looped around the first and second pulleys, the elongated member driven by the first pulley and configured to drive the second pulley for rotation about the second rotation axis.

20. A skateboard device, comprising:

a frame, comprising a tubular segment arranged in a front-to-back, longitudinal direction of the skateboard device;

a set of wheels providing rolling mobility to the frame, the set of wheels comprising one or more front wheels and one or more rear wheels;

a deck, carried by the frame, the deck comprising a front panel and a rear panel arranged over the tubular segment and configured for the stepping thereon of a front foot and a rear foot of a rider of the skateboard device, wherein the front panel is pivotably connected to the tubular segment and pivotable relative to the frame about a first rotation axis defined by a central longitudinal axis of the tubular segment, and the rear panel is non-movably secured to the tubular segment;

a front wheel fork, pivotably connected to the frame about a second rotation axis, the one or more front wheels rotatably attached to the front wheel fork about a front wheel rotation axis;

a first pulley, jointly rotatable with the front panel about the first rotation axis;

a second pulley, affixed to the front wheel fork and jointly rotatable with the front wheel fork and the one or more front wheels about the second rotation axis, the second rotation axis having a vertical component such that rotation of the second pulley, front wheel fork and one or more front wheels about the second rotation axis turns the one or more front wheels left or right; and an elongated member looped around the first and second pulleys, the elongated member driven by the first pulley and configured to drive the second pulley for rotation about the second rotation axis.

* * * * *